US010258536B2

(12) United States Patent
Oberdier

(10) Patent No.: US 10,258,536 B2
(45) Date of Patent: Apr. 16, 2019

(54) EXTERNAL PERIPHERAL VASCULAR OCCLUSION FOR ENHANCED CARDIOPULMONARY RESUSCITATION

(71) Applicant: Matthew Thomas Oberdier, Baltimore, MD (US)

(72) Inventor: Matthew Thomas Oberdier, Baltimore, MD (US)

( * ) Notice: Subject to any disclaimer, the term of this patent is extended or adjusted under 35 U.S.C. 154(b) by 735 days.

(21) Appl. No.: 14/836,445

(22) Filed: Aug. 26, 2015

(65) Prior Publication Data

US 2016/0058653 A1 Mar. 3, 2016

Related U.S. Application Data

(60) Provisional application No. 62/042,588, filed on Aug. 27, 2014.

(51) Int. Cl.
*A61H 9/00* (2006.01)
*A61H 31/00* (2006.01)

(52) U.S. Cl.
CPC ..... *A61H 9/0078* (2013.01); *A61H 9/0092* (2013.01); *A61H 31/004* (2013.01); *A61H 2201/164* (2013.01); *A61H 2201/1635* (2013.01); *A61H 2209/00* (2013.01)

(58) Field of Classification Search
CPC ... A61H 9/0078; A61H 9/0085; A61H 9/0092
See application file for complete search history.

(56) References Cited

U.S. PATENT DOCUMENTS 2,495,316 A * 1/1950 Clark ..... A41D 13/002 244/1 R
3,179,106 A * 4/1965 Meredith ..... A61H 9/0078 601/150
3,303,841 A * 2/1967 Dennis ..... A61H 9/0071 600/16
3,654,919 A * 4/1972 Birtwell ..... A61H 9/0078 601/151
3,659,593 A * 5/1972 Vail ..... A61H 9/0078 128/DIG. 15

(Continued)

OTHER PUBLICATIONS

Zhengfei Yang et al, "A Tourniquet Assisted Cardiopulmonary Resuscitation Augments Myocardial Perfusion in a Porcine Model of Cardiac Arrest", Resuscitation 86 (2015), pp. 49-53.

*Primary Examiner* — Joshua Lee
(74) *Attorney, Agent, or Firm* — Nixon & Vanderhye P.C.

(57) ABSTRACT

Systems and methods to externally compress or collapse the peripheral vascular system of a patient during CPR to mechanically redirect blood to the torso and head regions to enhance the likelihood of successful CPR outcomes. A plurality of sleeves adapted for placement on a patient's limbs during CPR, each sleeve including at least one inflatable fluid chamber, and at least one inflation source fluidly coupled to each of the inflatable fluid chambers of the sleeves. The sleeve chambers can be inflated to a desired compression pressure and maintained at the desired compression pressure continuously throughout CPR to prevent or restrict blood flow in the limbs. The compression pressure may be sufficient to redirect substantial blood from the patient's limbs to the patient's torso and head regions and enhance hemodynamic wave reflection during CPR.

17 Claims, 7 Drawing Sheets

(56) References Cited

U.S. PATENT DOCUMENTS 3,866,604 A * 2/1975 Curless ..... A61H 9/0078 601/152
4,013,069 A * 3/1977 Hasty ..... A61H 9/0078 601/152
4,753,226 A * 6/1988 Zheng ..... A61H 9/0078 601/150
4,865,020 A * 9/1989 Bullard ..... A61H 9/0078 601/152
5,109,832 A * 5/1992 Proctor ..... A61H 9/0078 137/624.14
5,370,603 A * 12/1994 Newman ..... A61H 9/0078 601/150
5,554,103 A * 9/1996 Zheng ..... A61B 5/0535 600/311
5,806,512 A * 9/1998 Abramov ..... A61H 9/0078 128/204.18
6,007,559 A * 12/1999 Arkans ..... A61B 17/135 601/150
6,010,470 A * 1/2000 Albery ..... A61H 9/0092 601/149
6,450,981 B1 * 9/2002 Shabty ..... A61H 9/0078 601/150
7,058,447 B2 * 6/2006 Hill ..... A61B 17/1355 601/151
7,244,225 B2 7/2007 Loeb et al.
7,314,478 B2 * 1/2008 Hui ..... A61G 7/05776 606/202
RE42,958 E 11/2011 Loeb et al.
8,277,399 B2 * 10/2012 Hamilton ..... A61H 9/0078 601/152
8,376,973 B2 * 2/2013 Flood ..... A61H 9/0078 601/149
8,394,042 B1 * 3/2013 Mirza ..... A61H 9/0078 601/149
8,568,341 B2 10/2013 Flood
9,265,693 B2 * 2/2016 Sudarev ..... A61B 5/0225
2003/0233061 A1 * 12/2003 Hui ..... A61H 9/0078 601/152
2005/0111996 A1 * 5/2005 Ma ..... A61H 9/0078 417/313
2005/0126578 A1 * 6/2005 Garrison ..... A61H 9/0078 128/874
2005/0159690 A1 * 7/2005 Barak ..... A61H 9/0078 601/149
2006/0004245 A1 * 1/2006 Pickett ..... A61H 9/0078 600/16
2007/0088239 A1 * 4/2007 Roth ..... A61H 9/0078 601/152
2008/0033228 A1 * 2/2008 Rastegar ..... A61H 9/0078 600/16
2008/0097264 A1 * 4/2008 Webster ..... A61H 9/0078 601/152
2009/0062701 A1 * 3/2009 Yannopoulos ..... A61H 9/0078 601/41
2009/0076423 A1 * 3/2009 Reeves ..... A61K 31/70 601/150
2009/0299239 A1 * 12/2009 Meyer ..... A61H 9/0078 601/149
2011/0196269 A1 * 8/2011 Arkans ..... A61H 9/0078 601/15
2015/0290073 A1 * 10/2015 Reeves ..... A61H 9/0078 601/149
2016/0129298 A1 * 5/2016 Sekula ..... A63B 21/0085 482/113
2017/0181921 A1 * 6/2017 Wren ..... A61H 9/0078
2018/0035902 A1 * 2/2018 Barak ..... A61B 5/02133

* cited by examiner

EXTERNAL PERIPHERAL VASCULAR OCCLUSION FOR ENHANCED CARDIOPULMONARY RESUSCITATION

RELATED APPLICATION

This application claims the benefit of non-provisional U.S. patent application 62/042,588, filed Aug. 27, 2014, the entirety of which is incorporated by reference.

FIELD

This application is related to systems and methods involving cardiopulmonary resuscitation (CPR).

BACKGROUND

CPR associated with sudden cardiac death typically has a low rate of success. CPR is complicated by rescuer knowledge, technique, and endurance, which some automated devices have been shown to improve. However, effective perfusion of the most critical and metabolically demanding organs remains a limiting factor even during ideal resuscitation efforts.

Further, current resuscitation protocols involve the use of epinephrine and other vasoconstrictors to enhance blood flow to central organs. Nonetheless, epinephrine has been shown to cause myocardial necrosis and to be harmful when given in suboptimal doses during resuscitation. Epinephrine also has the unintended effect of making the aorta relatively more stiff, which diminishes blood flow distribution in a healthy person.

SUMMARY

Disclosed are mechanical systems and methods that can serve to externally compress and/or collapse the peripheral vascular system to redirect blood to the torso and head regions of a patient to enhance CPR.

An exemplary system for enhancing CPR comprises a plurality of sleeves adapted for placement on a patient's limbs during CPR, with each sleeve including at least one inflatable fluid chamber, and at least one inflation source fluidly coupled to each of the inflatable fluid chambers of the sleeves and operable to inflate the fluid chambers to a desired compression pressure and maintain the desired compression pressure throughout CPR. The desired compression pressure can be sufficient to redirect blood from the patient's limbs to the patient's torso and head regions during CPR.

In some embodiments, the system can include at least one sleeve for each arm and at least one sleeve for each leg. In some embodiments, the system comprises at least two sleeves for at least one of the patient's limbs. In some embodiments, at least one of the sleeves includes two or more inflatable fluid chambers. The two or more inflatable chambers can include a least one chamber that is positioned distally to another one of the chambers, and/or can include at least one chamber that is positioned laterally relative to another chamber. In some embodiments, the fluid chambers can extend annularly around the patient's limbs in a ring-shape. In some embodiments, at least two of the fluid chambers are fluidly coupled by a relief valve that opens when a pressure differential between the coupled chambers exceeds a predetermined threshold value.

In some embodiments, at least one of the sleeves can comprise a tourniquet-style inflatable chamber configured to be positioned around the patient's armpit or groin. All sleeve embodiments to substantially restrict or prevent blood flow to the respective limb and to provide a unified hemodynamic wave reflection site during CPR.

In some embodiments, the system includes a user interface having an inflation pressure selection controller operable to set a maximum inflation pressure of the fluid chambers. In some embodiments, the system can include a release valve operable to relieve pressure from the fluid chambers. In some embodiments, the system can include one or more pressure sensors located in or adjacent the fluid chambers and operable to sense the level of pressure being applied to the patient's limbs.

An exemplary method for enhancing CPR comprises applying one or more sleeves around a patient's limbs prior to or during CPR, and then inflating at least one chamber of each sleeve to apply external pressure to the respective limb such that the limb's vasculature is partially or completely collapsed and blood is redirected toward the torso and head regions of the patient during CPR.

The applied external pressure can be continuously maintained throughout CPR. In some methods, the applied external pressure is continuously maintained above systolic blood pressure in the patient's limbs during CPR.

In some methods, applying one or more sleeves comprises applying one sleeve around each leg of the patient and one sleeve around each arm of the patient. In some methods, inflating at least one chamber of each sleeve comprises inflating two or more chambers in at least one sleeve. For example, the two or more chambers can be inflated in sequence. In some methods, the two or more chambers can be inflated in a distal to proximal sequence.

In some methods, inflating at least one chamber comprises selecting a desired maximum inflation pressure for the at least one chamber at a user interface. Some methods further include monitoring a current inflation pressure in the at least one chamber during CPR and adjusting the inflation pressure. The chambers can be deflated upon completion of CPR.

The foregoing and other objects, features, and advantages of the disclosed technology will become more apparent from the following detailed description, which proceeds with reference to the accompanying figures.

DETAILED DESCRIPTION

The peripheral vascular system contains a large portion of the blood volume and can tolerate relatively long periods of compromised perfusion. The disclosed mechanical systems and methods serve to externally compress and/or collapse the peripheral vascular system to redirect blood to the torso and head regions and to provide a unified hemodynamic wave reflection site during CPR.

Figure 1:
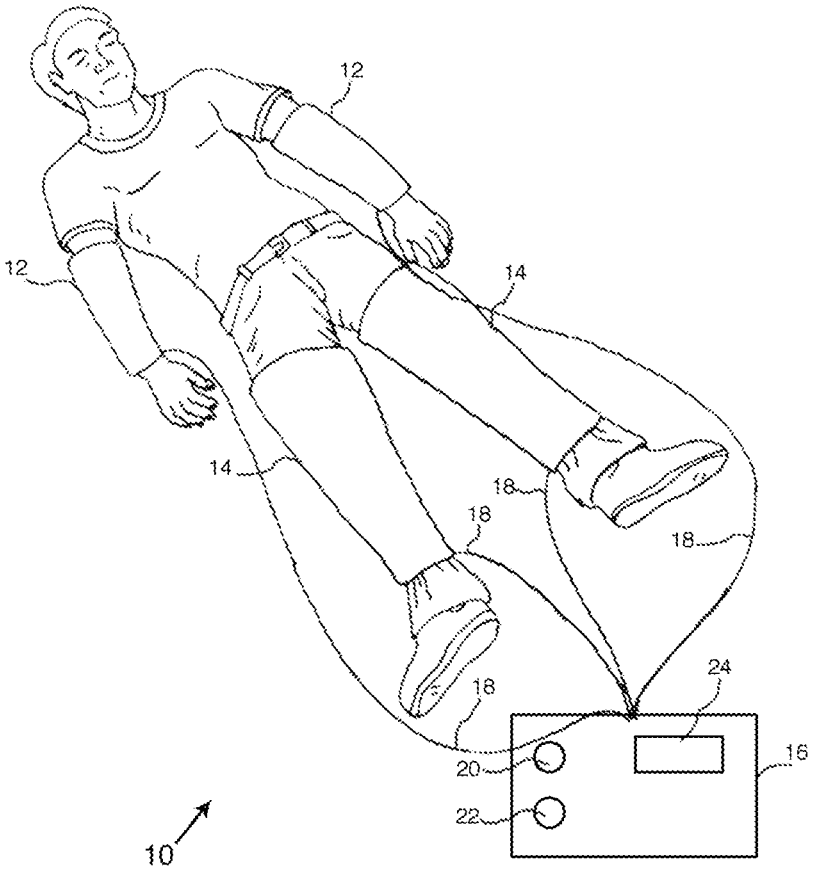
FIG. 1 is a schematic view of a CPR patient with inflatable sleeves positioned around the patient's limbs and coupled to an inflation controller.

Exemplary systems can comprise one or more tubular sleeves, such as one sleeve for each limb, as shown in FIG. 1. The system 10 of FIG. 1 includes two arm sleeves 12 and two leg sleeves 14, with each sleeve coupled to an inflation controller 16 via independent inflation conduits 18.

In some systems, two sleeves are provided for application specifically on the legs. In some systems, two sleeves are provided for application specifically on the arms. The sleeves can be sized and shaped to fit around different sized limbs, include smaller sized sleeves for infants and children, and larger sized sleeves for bariatric patients. The sleeves can comprise flexible, strong materials, such as woven polymeric materials (e.g., nylon), and include one or more inflatable chambers.

Figure 2:
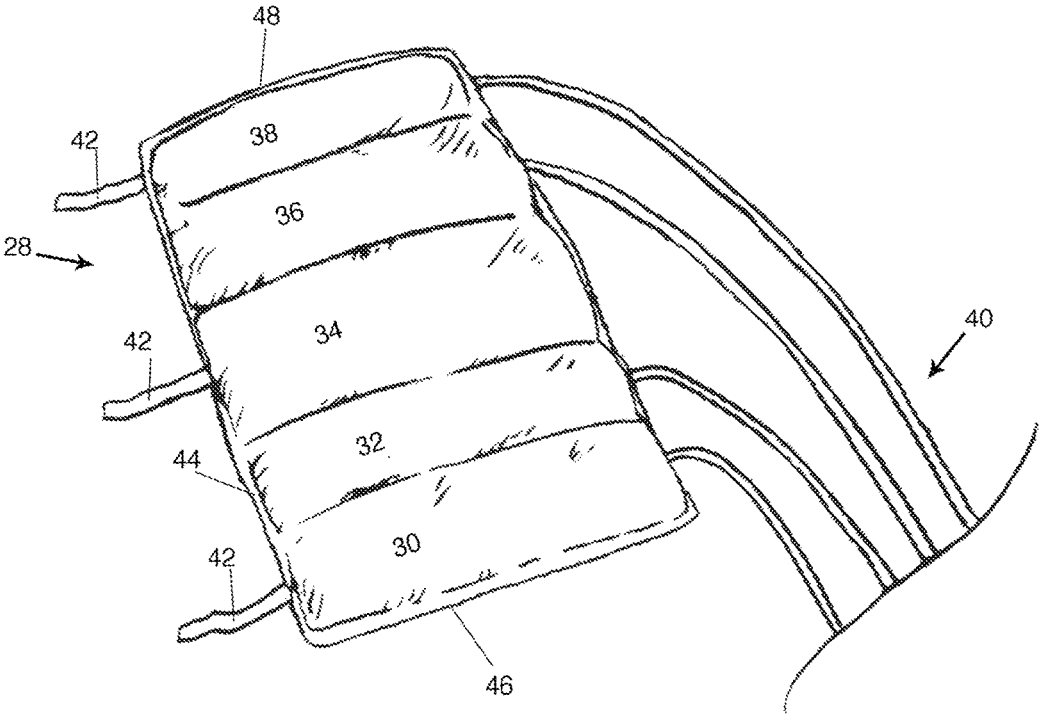
FIG. 2 is a plan view of an exemplary sleeve in an unrolled, flattened configuration. The sleeve includes plural laterally extending chambers individually coupled to an inflation source.
Figure 3:
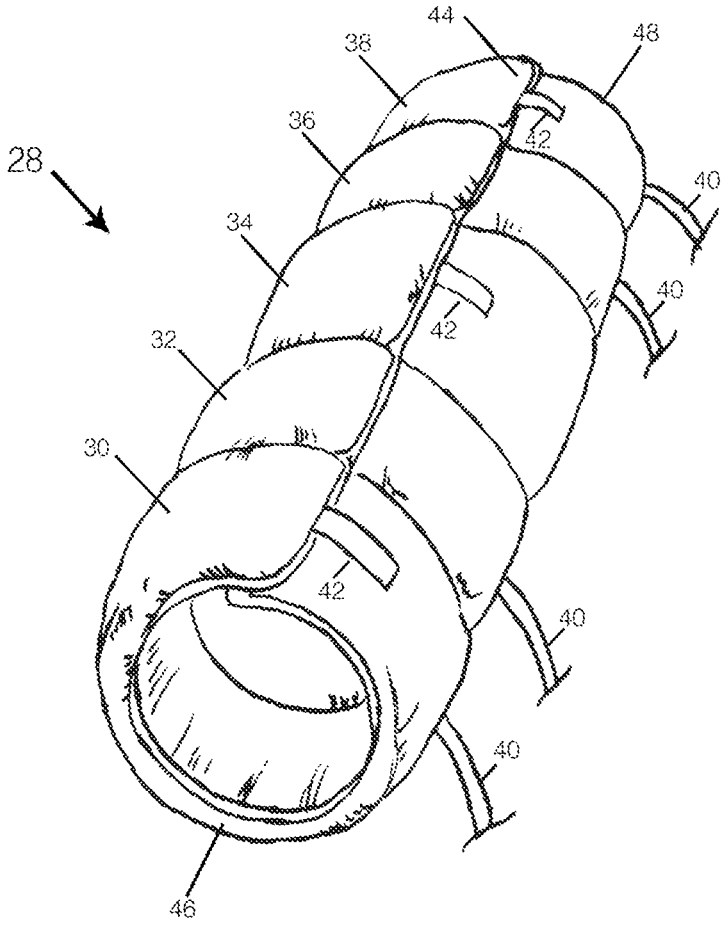
FIG. 3 is a perspective view of the sleeve of FIG. 2 in a rolled-up operative configuration, showing an annular orientation of the chambers.

In some embodiments, the sleeves can be tubular and configured to slide over the hand or foot then proximally in position around the limb. In other embodiments, the sleeves can have a longitudinal opening that allows the sleeve to uncurl or flex open to allow the opened sleeve to be applied laterally over the side of a limb. Such a sleeve can then be curled around the limb and secured in a tubular configuration, such as using straps, wraps, buckles, clips, snaps, hook-and-loop fasteners, or other fasteners. FIGS. 2 and 3 show an example of a sleeve 28 with a longitudinal seem or opening 44 that can be unrolled to a flattened position, as shown in FIG. 2. The sleeve 28 includes straps 42 on one lateral side that attach to the other lateral side in the rolled-up operative configuration, as shown in FIG. 3.

The length of the sleeves can vary. Some sleeves are configured to extend over the whole limb including the hand or foot. Some sleeves are configured to extend from near the wrist to near the armpit (e.g., sleeves 12 in FIG. 1), or from near the ankle to near the groin (e.g., sleeves 14 in FIG. 1). Some sleeves are configured to extend from near the elbow to near the armpit, from near the wrist to near the armpit, from near the ankle to near the knee (e.g., sleeves 94 and 98 in FIG. 6), or from near the knee to near the groin (e.g., sleeves 92 and 96 in FIG. 6). Other sleeves can be configured to cover other portions of the limbs.

Figure 6:
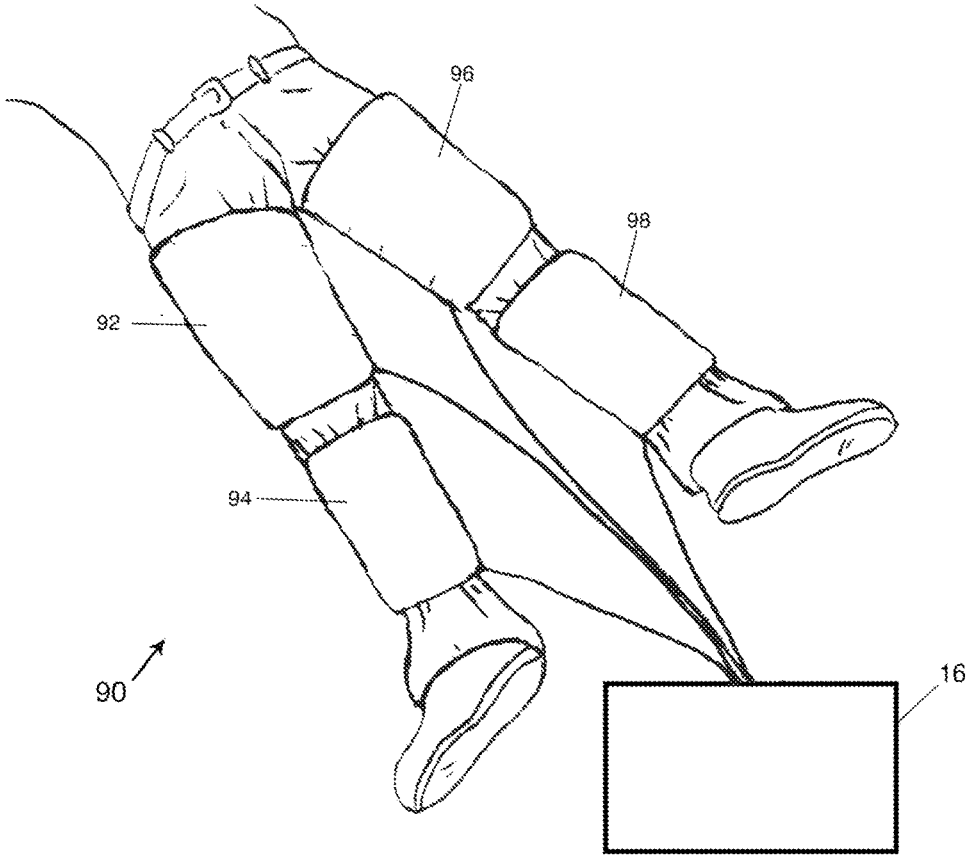
FIG. 6 is a schematic view of a lower body portion of a CPR patient with two sleeves positioned on each leg, one around the thigh region and one around the calf region.

In some embodiments, two or more sleeves can be provided for each limb. For example, one sleeve can be adapted to be placed around a thigh or upper arm region while another sleeve can be adapted to be positioned around the calf region or forearm region. The system 90 in FIG. 6 shows such an example, with the two thigh sleeves 92, 96 and the two calf sleeves 94, 98 each fluidly coupled to an inflation controller 100. In some embodiments, independent sleeves can be configured to cover the hands and/or feet. In some embodiments, joints such as the elbows, knees, wrists, and ankles can be left uncovered by the sleeves, as is exemplified in FIG. 6.

Each sleeve can include one or more inflatable chambers. In some embodiments, each chamber can extend circumferentially or annularly around the limb in a ring shape (e.g., the sleeve 28 in FIGS. 2 and 3, and the sleeve 50 in FIG. 4), while in other embodiments the chambers can extend longitudinally along the limb (e.g., the sleeve 70 in FIG. 5), or in other orientations. In some embodiments, the sleeves include portions that extend over the knee, elbow or other joint, but do not include fluid chambers in the portion that covers the joint. For example, the sleeve 28 in FIG. 2 includes distal fluid chambers 30 and 32 that can cover the calf or forearm region, proximal fluid chambers 36 and 38 that can cover the thigh or upper arm region, and a connecting portion 34 that extends over the knee or elbow but that does not include inflatable fluid chambers. By not including compression chambers over joints, the patient's limbs can remain more flexible at those joints while the sleeves are inflated during CPR, which improves overall mobility of the patient.

In some embodiments, one or more of the sleeves can include a series of chambers adapted such that the series of chambers can be sequentially inflated. For example, the sleeve 28 in FIG. 2 includes plural annular chambers 30, 32, 36, 38 that each extend circumferentially around the limb when curled up around a limb. The plural annular chambers can be inflated in sequence from the most distal annular chamber 30 to the most proximal annular chamber 38. Such an inflation sequence can help direct the displaced blood from the limbs toward and into the torso and head regions.

In some embodiments, some or all of the chambers are independently fluidly coupled to an inflation source and not fluidly coupled to one another, as in the sleeve 28 in FIG. 2. In such embodiments, each of the chambers can be independently inflated by an inflation source. For example, each of the chambers can be independently inflated in a sequential pattern, such as starting from a most distal chamber 30 and ending with a most proximal chamber 38. The inflation of the different chambers can partially overlap in time, such as with a second chamber 32 beginning to inflate while the first chamber 30 is only partially inflated. In other embodiments, all or some of the chambers can be independently inflated at the same time.

Figure 4:
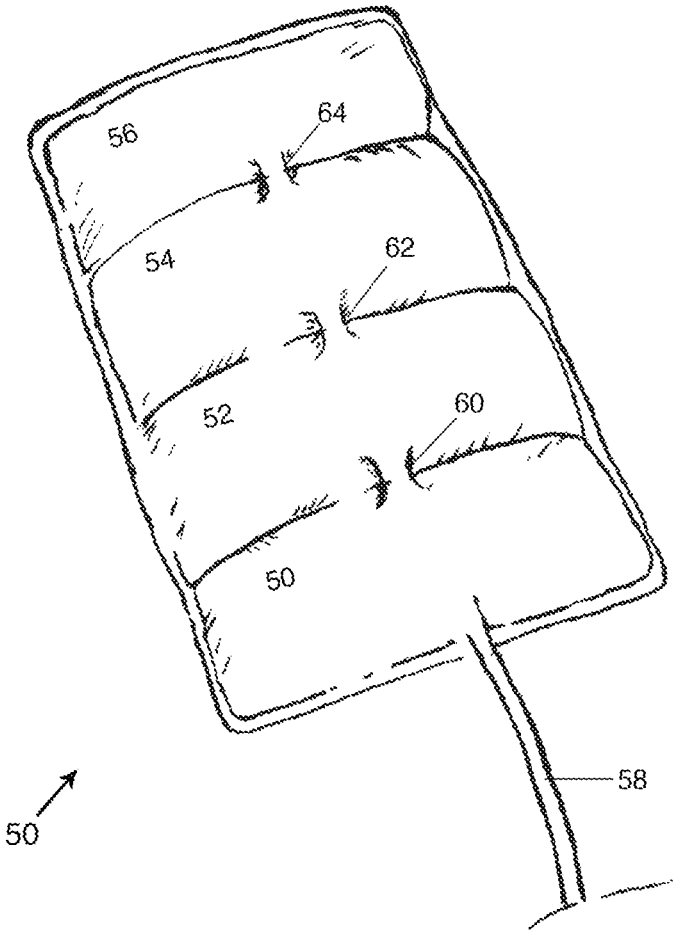
FIG. 4 is a plan view of another exemplary sleeve in an unrolled, flattened configuration. The sleeve includes a plurality of laterally extending chambers coupled together by valves.
Figure 5:
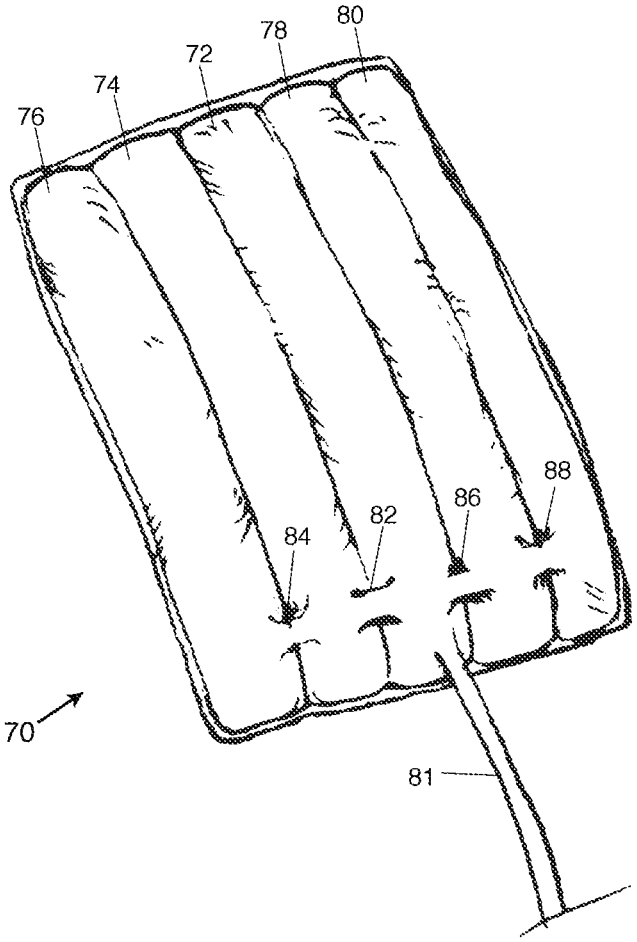
FIG. 5 is a plan view of another exemplary sleeve in an unrolled, flattened configuration. The sleeve includes a plurality of longitudinally extending chambers coupled together by valves.

In some embodiments, two or more of the chambers are fluidly coupled together within the sleeve, such as the sleeve 50 in FIG. 4 and the sleeve 70 in FIG. 5. In some such embodiments, the coupled chambers can be fluidly coupled in an unrestricted or open connection such that the coupled chambers inflate together at approximately the same time from a single inflation source. For example, in the sleeve 70 in FIG. 5, a single inflation conduit 81 delivers inflation fluid to chamber 72 and the fluid can then freely flow laterally to the chambers 74 and 76 via passageways 82 and 84, and then can freely flow laterally to the chambers 78 and 80 via passageways 86 and 88 to inflate all five chambers at approximately the same time.

In some embodiments, two or more of the fluidly coupled chambers can be connected via a relief valve or other regulator that only opens to allow fluid passage above a certain pressure or pressure differential. For example, in the sleeve 50 of FIG. 4, a single inflation conduit 58 can be coupled to the most distal chamber 50, and when the most distal chamber 50 is inflated above a predetermined pressure, a valve 60 opens that fluidly couples the most distal chamber 50 to an adjacent second chamber 52 such that the second chamber 52 begins to inflate. Once the second chamber 52 reaches a predetermined pressure, another valve 62 can open that fluidly couples the second chamber 52 to a third chamber 54, and so on. This process can repeat in a generally distal to proximal direction, for example, until a most proximal chamber 56 is inflated last via a most proximal valve 64. Other inflation sequence patterns can also be employed.

The inflation fluid can comprise any suitable gas and/or liquid, such as air.

The sleeve chambers may be inflated from two or more independent sources or from a common centralized source, such as the inflation controller 16 in FIG. 1. The inflation source(s) can comprise any suitable device, such as a pneumatic or hydraulic pump, a pressurized fluid container, a blower, etc. Upon deflation of the chambers, the fluid can be exhausted out of the system, or can be returned back to the fluid source, or can be routed to another location.

The inflation source(s) can comprise or be coupled to a user interface to control the operation of the system. The user interface can include, for example, a pressure selection controller 20 that allows a clinician to select a desired inflation pressure for the sleeves. The user interface can also include a pump on/off switch, an inflation start/stop switch, a pressure release valve, and/or an emergency deflation switch, shown generally as 22. The user interface can also include a visual display 24 that indicates system parameters, such as whether or not pressure is being applied and/or what the current inflation pressure is. Pressure sensors can be included in some or all of the fluid chambers of the sleeves and electrically coupled to the user interface to provide live pressure readings.

In some embodiments, the sleeves, when applied to limbs and inflated, can impose a continuous pressure that can be great enough to collapse the limb vasculature under the sleeves and substantially prevent blood flow in the limbs during the CPR procedure. This can result in more of the blood flow being directed towards the torso and headregions where it is needed most. In some embodiments the continuous sleeve pressure may be greater than systolic blood pressure (e.g., greater than 160 mmHg, greater than 200 mmHg, or other continuous pressures). In other embodiments, the maximum pressure may approximate venous pressure, such as greater than 10 mmHg. In some embodiments, the pressure in the chambers can be varied during a CPR procedure independent of the compression rate, such as cycles of continuously maintained pressure for ten seconds or more followed by a lowered or entirely relieved sleeve pressure for ten seconds or more. In some embodiments, the pressure can vary from near 10 mmHg up to or beyond systolic blood pressure (e.g., at least 160 mmHg). In other embodiments, the applied pressure can vary from near 10 mmHg to a maximum that is less than 160 mmHg.

Figure 7:
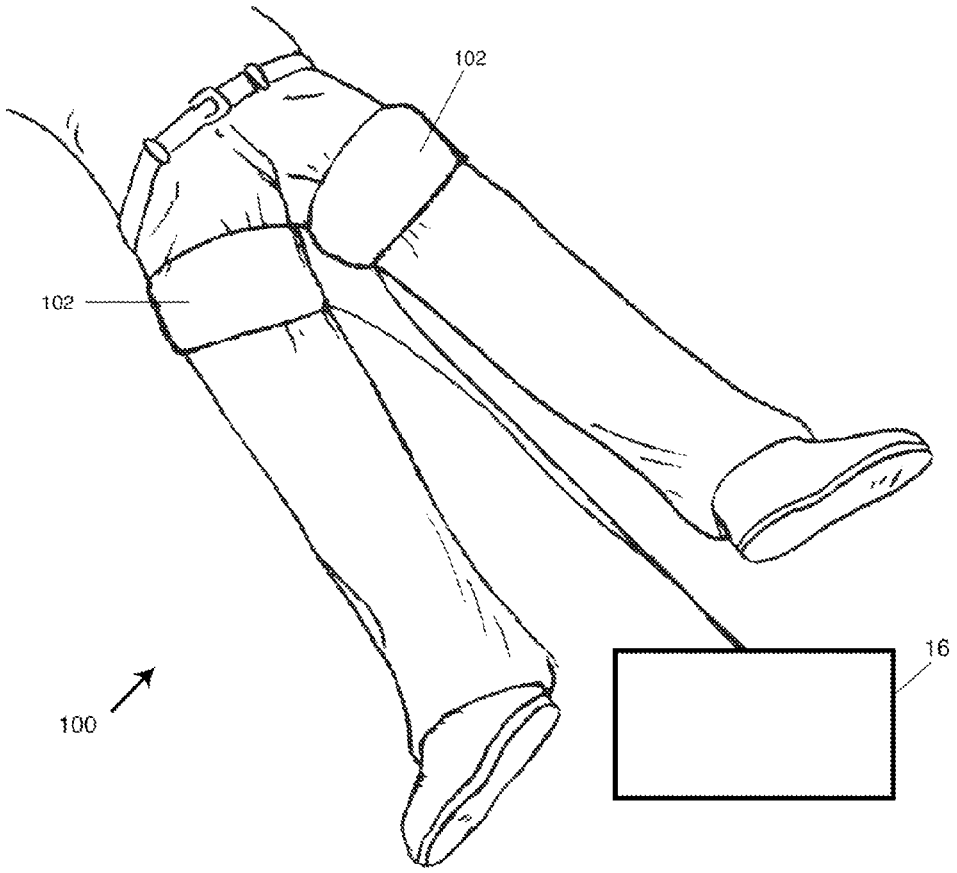
FIG. 7 is a schematic view of a lower body portion of a CPR patient with two tourniquet-type inflatable chambers positioned around the groin regions of the legs.

In some embodiments, the system can comprise a single tourniquet-type chamber located at the most proximal portion of each of one or more limbs. Such tourniquet-type chambers can include an approximately one inch wide (or narrower or wider) chamber located proximal to the torso, such as under the armpits and/or around the groin region. For example, FIG. 7 shows an exemplary system 100 including two inflatable tourniquet-type chambers 102 located around the groin regions of a patient's legs. In any of the described embodiments, upon completion of CPR, the sleeves can be deflated and removed.

Using the disclosed systems and methods, heart preload can be enhanced and sternal compressions can better augment cardiac output. Also, because the blood volume of the central circulatory system can be preserved while the overall volume of the circulatory system is decreased via exclusion of the peripheral vasculature, perfusion pressure to the most critical organ systems can be enhanced. In addition, collapse of the peripheral circulation can enhance pulse wave reflection, which in turn can increase pulse pressure and perfusion during external chest compression diastole. Together, these hemodynamic changes can enhance CPR outcomes.

Furthermore, the disclosed systems and methods can help optimize or reduce the dosage of epinephrine, vasopressin, and/or other pharmacotherapy administered during CPR. Epinephrine is often given during CPR because it assists the heart in being resuscitated and induces peripheral vasoconstriction. Vasopressin is often administered for peripheral vasoconstriction after an initial dose of epinephrine is administered. Vasopressin also constricts coronary and renal arterioles. However, although use of epinephrine, vasopressin, and/or other pharmacotherapy can lead to a greater percentage of resuscitations, less favorable overall outcomes may potentially result due to increased inotropy and myocardial oxygen consumption after resuscitation. Hence, the disclosed systems and methods may reduce or eliminate the need for pharmacologically-induced peripheral vasoconstriction, and thus lower doses of such drugs may be sufficient to revive the heart while not increasing inotropy and myocardial oxygen consumption. In addition, mechanical compression (as provided by the herein described systems) can selectively act on all levels of the vasculature in the limbs (e.g., major arteries to capillaries to veins; macro- to microcirculation) depending on the applied pressure. For example, an applied pressure of 30 mmHg would collapse the veins, but not the capillaries or arterial system. In contrast, a pharmacotherapy approach may be primarily effective at the level of the microcirculation (e.g., arterioles) and may also act on organs in the torso, in addition to the microcirculation of the limbs. Hence, the mechanical approaches provided by the disclosed systems and methods may have a greater impact on blood volume and hemodynamic wave reflection while having similar or improved effects on systemic vascular resistance.

The disclosed systems and methods can complement, or be independent of, automated CPR systems and other devices such as those that enhance intrathoracic pressure by airway occlusion. The disclosed systems and methods can be utilized in public, first-aid, and clinical settings.

Exemplary Method

In an exemplary method, any of the disclosed systems can be used in combination with CPR on an asystolic subject. One or more sleeves of the system can be place on the subjects limbs prior to beginning chest compressions, after beginning chest compressions, or simultaneous with beginning chest compression. Each applied sleeve can be provided in an unrolled, open, deflated configuration (for embodiments such as those shown in FIGS. 2-5) and placed around the subject's limbs. The sleeves can be secured on the limbs using straps or other fasteners. Once applied on the limbs, a clinician can select a desired compression pressure and begin inflating the sleeves using controls at the user interface. The sleeves can be inflated from the same pump or fluid source or from two or more pumps or fluid sources, and the pressures in each chamber can be substantially the same or can be different from one another. The sleeves can be inflated in a sequence starting from the most distal chamber toward the most proximal chamber to assist in redirecting blood from the limbs to the torso and head. The pressure can be maintained in the sleeves at the selected pressure(s) while CPR is in progress. The inflated sleeves can apply sufficient pressure to collapse the vasculature in the limbs and keep the vasculature collapsed even during maximum blood pressure in order to maintain more blood in the torso and head regions to help prevent vital organs from failing or being damaged until the subject has be resuscitated. During CPR, a clinician can monitor the applied pressure in the inflatable chambers via a display on the user interface and can make adjustments to the applied pressure as needed. Upon completion of CPR, whether successful or not, the clinician can release the pressure in the fluid chambers using controls on the user interface, allowing the inflation fluid to be exhausted or otherwise released from the fluid chambers in the sleeves. The sleeves can then be unfastened and/or removed off of the patient's limbs.

Definition of Terms

As used herein, the terms "distal" and "distally" refer to a location or direction that is, or a portion of a device that when used (for example placed over a limb) is, farther away from the heart. The terms "proximal" and "proximally" refer to a location or direction that is, or a portion of a device that when used is, closer to the heart.

The term "continuous" refers to a sleeve pressure that is elevated above 10 mmHg at steady state for more than ten seconds and is independent of CPR compression rate. That is, a graph of sleeve pressure versus time would appear as a series of stairs of at least 10 mmHg at intervals of no less than ten seconds.

The singular terms "a", "an", and "the" include plural referents unless context clearly indicates otherwise. The term "comprises" means "includes without limitation." The term "coupled" means physically linked and does not exclude intermediate elements between the coupled elements. The term "and/or" means any one or more of the elements listed. Thus, the term "A and/or B" means "A" or "B" or "A and B."

Although methods and materials similar or equivalent to those described herein can be used in the practice of the present technology, only certain suitable methods and materials are described herein. In case of conflict, the present specification, including terms, will control. In addition, the materials, methods, and devices are illustrative only and not intended to be limiting.

In view of the many possible embodiments to which the principles of the disclosed technology may be applied, it should be recognized that the illustrated embodiments are only preferred examples and should not be taken as limiting the scope of the disclosure. Rather, the scope of the disclosure is at least as broad as the following claims. I therefore reserve the right to claim at least all that comes within the scope of the following claims.

I claim:

1. A method for enhancing cardiopulmonary resuscitation (CPR), the method comprising:

applying one or more sleeves around a limb of the patient prior to or during CPR, wherein the one or more sleeves have chambers arranged along the limb and the chambers include a distal chamber at a distal region of the limb and a proximal chamber at a proximal region of the limb;

inflating the distal chamber to at least 160 mmHg to apply external pressure to the distal region of the limb such that the limb's vasculature in the distal region of the limb is at least partially collapsed and blood is redirected away from the distal portion of the limb and toward the proximal region during CPR, wherein during the inflation of the distal chamber, the proximal chamber is isolated from a source of pressurized fluid used to inflate the distal chamber;

after the inflation of the distal chamber is completed and is being maintained, inflating the proximal chamber to at least 160 mmHg to apply external pressure to the proximal region of the limb such that the limb's vasculature in the proximal region of the limb is at least partially collapsed to suppress blood entering and blood is redirected away from the limb during CPR, and maintaining continuously the applied external pressures to the distal and the proximal chambers during the remainder of CPR, wherein the maintaining of the applied external pressure suppresses peripheral circulation of blood in the limb and enhances pulse wave reflection of blood in the vasculature during CPR.

2. The method of claim 1, wherein the external pressure applied by the distal chamber is continuously maintained above systolic blood pressure during CPR.

3. The method of claim 1, wherein the limb is a leg or an arm, and the one or more sleeves are applied to the leg or the arm.

4. The method of claim 1, wherein the inflation of the distal and proximal chambers comprises selecting a desired maximum inflation pressure at a user interface.

5. The method of claim 1, further comprising monitoring a current inflation pressure in each of the distal and proximal chambers during CPR and automatically adjusting the inflation pressure in at least one of the distal and proximal chambers in response to an excessive pressure condition in one of the distal and proximal chambers.

6. The method of claim 1, further comprising deflating the chambers upon completion of CPR.

7. The method of claim 1 wherein the chambers include at least four chambers and the at least four chambers are sequentially inflated starting with the distal chamber and proceeding with each next most distal chamber until the proximal chamber is inflated.

8. A system for enhancing cardiopulmonary resuscitation (CPR), the system comprising:

sleeves adapted for placement on a limb of a patient during CPR, each sleeve including at least one inflatable fluid chamber and the sleeves include a distal sleeve configured be placed on a distal region of the limb and a proximal sleeve configured to be placed on proximal region of the limb;

at least one inflation source fluidly coupled to each of the inflatable fluid chambers of the sleeves and operable to inflate the fluid chambers to a desired compression pressure and maintain the desired compression pressure throughout CPR, the desired compression pressure being sufficient to redirect blood out of the patient's limb during CPR, and a controller configured to control the inflation of the inflatable fluid chambers of the sleeves, wherein the controller is configured to:

(i) first inflate the distal sleeve to at least 160 mmHg to apply external pressure to the distal region of the limb such that the limb's vasculature in the distal region of the limb is at least partially collapsed and blood is redirected away from the distal portion of the limb and toward the proximal region of the limb, wherein during the inflation of the distal sleeve the controller does not inflate the proximal sleeve sufficiently to at least partially collapse the vasculature in the proximal region of the limb and the proximal sleeve is isolated from a source of pressurized fluid applied to inflate the distal sleeve, (ii) after the inflation of the distal sleeve is completed and while the inflation of the distal sleeve is maintained, inflate the proximal sleeve to at least 160 mmHg to apply external pressure to the proximal region of the limb such that the vasculature in the proximal region is at least partially collapsed and blood is directed out of the limb during CPR, and (iii) after the inflation of the proximal sleeve, maintain the inflation of the proximal and distal sleeves during the remainder of CPR to suppress peripheral circulation of blood in the limb and enhance pulse wave reflection of blood in the vasculature during CPR.

9. The system of claim 8, wherein the sleeves are adapted to be applied to a leg or an arm.

10. The system of claim 8, wherein at least one of the sleeves includes two or more inflatable fluid chambers.

11. The system of claim 10, wherein the fluid chambers extend annularly around the limb in a ring-shape.

12. The system of claim 10, wherein at least two of the fluid chambers are fluidly coupled by a relief valve that opens when a pressure differential between the coupled chambers exceeds a predetermined threshold value.

13. The system of claim 8, further comprising a user interface that includes inflation pressure selection inputs operable to set minimum and maximum inflation pressure of the fluid chambers.

14. The system of claim 8, further comprising a user interface that includes duration selection inputs to set minimum and maximum pressure durations.

15. The system of claim 8, further comprising a release valve operable to relieve pressure from the fluid chambers.

16. The system of claim 8, further comprising one or more pressure sensors located in or adjacent to the fluid chambers and operable to sense the level of pressure being applied to the limb.

17. The system of claim 8, further comprising a tourniquet-style inflatable chamber located around the patient's armpit or groin to prevent or substantially restrict blood flow to the respective limb and enhance hemodynamic wave reflection during CPR.

* * * * *